US005341148A

United States Patent [19]

Walter et al.

[11] Patent Number: 5,341,148

[45] Date of Patent: Aug. 23, 1994

[54] HIGH FREQUENCY MULTI-TURN LOOP ANTENNA IN CAVITY

[75] Inventors: Carlton H. Walter; Donn V. Campbell, both of Poway; Robert V. Devore, Ramona, all of Calif.

[73] Assignee: TRW Inc., Redondo Beach, Calif.

[21] Appl. No.: 799,793

[22] Filed: Nov. 29, 1991

[51] Int. Cl.[5] ..... H01Q 11/12

[52] U.S. Cl. ..... 343/742; 343/745; 343/895; 343/708

[58] Field of Search ..... 343/741, 742, 841, 866, 343/867, 788, 789, 705, 708, 745; 29/600; H01Q 11/12

[56] References Cited

U.S. PATENT DOCUMENTS

| | | | |
|---|---|---|---|
| 2,472,106 | 6/1949 | Hansen | 343/741 |
| 3,568,206 | 3/1971 | Sisson | 343/789 |
| 3,823,403 | 7/1974 | Walter et al. | 343/745 |
| 3,956,751 | 5/1976 | Herman | 343/895 |
| 4,288,794 | 9/1981 | Osborne et al. | 343/742 |
| 4,644,366 | 2/1987 | Scholz | 343/895 |
| 4,801,944 | 1/1989 | Madnick et al. | 343/742 |
| 4,804,968 | 2/1989 | Ohe et al. | 343/741 |

*Primary Examiner*—Donald Hajec
*Assistant Examiner*—Tan Ho

[57] ABSTRACT

A compact high frequency multi-turn loop antenna is provided for use on a conductive structure such as the airframe of an airborne vehicle. The antenna employs a plurality of interconnected conductive loops which are magnetically coupled to a conductive structure. One end of the conductive loops is coupled via tuning and impedance matching circuits to a transceiver for transmitting and receiving signals therefrom. The other end of the conductive loops is coupled to ground. When transmitting a signal, the transceiver excites a current on the conductor which induces a magnetic field that excites the conductive structure. Upon receiving a signal, the conductive structure is excited which in turn generates a magnetic field through the plurality of loops and induces a current on the conductor. The antenna may advantageously be mounted within a conductive cavity structure which in turn is connected to the conductive structure.

22 Claims, 6 Drawing Sheets

HIGH FREQUENCY MULTI-TURN LOOP ANTENNA IN CAVITY

BACKGROUND OF THE INVENTION

1. Technical Field

This invention relates generally to an antenna system and, more particularly, to a high frequency multi-turn loop antenna for use on a conductive structure such as the airframe of an airborne vehicle.

2. Discussion

Many communication systems generally employ antennas for transmitting and receiving communications signals. High frequency antennas for use with airborne vehicles and the like have been employed. However, such antennas have generally been relatively large and/or have presented various operational problems.

One common high frequency airborne antenna currently in use with aircraft vehicles is a trailing wire antenna (TWA). The TWA is essentially a horizontal dipole which generally employs a weighted trailing wire that for some applications may be 140 feet or more in length. The relatively large size of the trailing wire is required to produce the necessary resonance. The trailing wire in conjunction with the airframe of the aircraft may provide the necessary length and shape for transmitting or receiving desired signals.

The TWA has been developed into a relatively efficient antenna, however, various undesirable operational problems do exist. Such problems include decreased maneuverability of the aircraft due to the external wire. In addition, it is generally required that the trailing wire of the TWA must be fully secured for aircraft landing. Other problems have included reliability and safety issues which have arisen with respect to the trailing wire extension and retraction mechanism. Furthermore, the relatively high rate of mechanism failure of the TWA and the circuitry of the explosive "guillotine" for purposes of severing the TWA when necessary have demonstrated a somewhat poor reliability.

Another high frequency antenna deployed on airborne vehicles is the towel bar antenna which essentially provides a single turn loop antenna. However, the towel bar antenna is relatively large in size and does not provide the best possible efficiency.

It is therefore desirable to obtain a compact high frequency antenna for use on a conductive structure such as an airborne vehicle. More particularly, it is desirable to obtain a compact high frequency multi-turn loop antenna which may be flush-mounted or embedded within the conductive structure.

SUMMARY OF THE INVENTION

In accordance with the teachings of the present invention, a compact high frequency multi-turn loop antenna is provided for use on a conductive structure such as an airborne vehicle. The antenna employs a conductor which forms a plurality of interconnected loops that are magnetically coupled to a conductive structure. One end of the conductor is adapted to be coupled to a transceiver for transmitting and receiving signals therefrom. The other end of the conductor is grounded or terminated in a tuner. The antenna is mounted within a small conductive cavity structure which is adapted to be connected to a conductive structure such as the airframe of an aircraft.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENT

Figure 1:
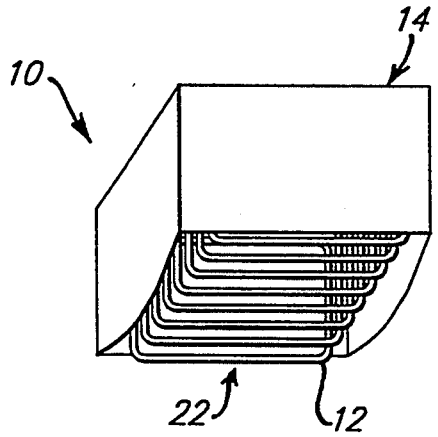
FIG. 1 is a schematic diagram which illustrates a multi-turn loop antenna in a cavity in accordance with the present invention.

Turning now to FIG. 1, a compact multi-turn loop antenna 10 is shown mounted within a small conductive cavity assembly 14. The antenna 10 includes a conductor which forms a plurality of multi-turn loops 12 located in a cavity 22 of the cavity assembly 14. The plurality of loops 12 essentially induce or are induced by a magnetic field which allows the antenna 10 to transmit and receive desired radio signals. The antenna 10 generally operates most effectively in the high frequency band from approximately 2 to 30 MHz. (i.e., wavelengths of 150 to 10 meters). However, the antenna 10 may provide adequate operation for other frequencies.

The cavity assembly 14 is adapted to be mounted onto or within a conductive structure (not shown). Such a structure may include the conductive airframe of an aircraft or other conductive structures preferably having a characteristic dimension with an effective length of one-fourth wavelength of the desired operating signal or greater. Smaller structures may suffice, however, the antenna efficiency will generally be lower. As a result, the conductor forming the plurality of loops 12 is sufficiently close to the conductive structure to allow strong magnetic coupling therebetween. When the conductive structure receives a signal from either a remote source or the antenna 10, an electric field is excited thereon. By exciting the conductive structure on which the antenna 10 is mounted, a higher antenna efficiency is thus obtainable.

Figure 2:
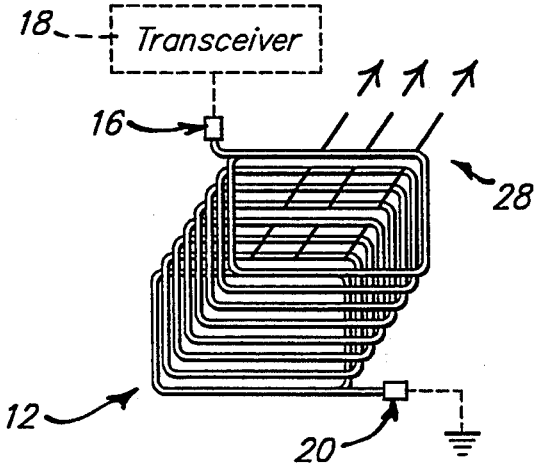
FIG. 2 is a schematic diagram which illustrates a multi-turn loop antenna in accordance with the present invention.

The plurality of loops 12 are further shown in FIG. 2 with the cavity assembly 14 removed. The conductor forming the plurality of loops 12 has a first end 16 and a second end 20. The first end 16 of the plurality of loops 12 is adapted to be coupled to a radio transmitting and receiving device such as a transceiver 18. The transceiver 18 communicates with the plurality of loops 12 to transmit and receive signals therewith. The second end 20 of the plurality of loops 12 is coupled to the cavity assembly 14 or otherwise grounded directly or through a terminating network. As a result, the conductor is capable of allowing a current to conduct therethrough.

In operation, the antenna 10 is preferably connected to a conductive structure which is capable of being excited with an electric field. Under receiving conditions, the antenna receives a signal from a remote source. The received signal excites the conductive structure and thereby creates an electric field thereon. The electric field essentially provides an electric current which flows along the surface of the conductive structure. As a result, the current thereby induces a magnetic field about the surface of the conductive structure. The plurality of loops 12 formed by the conductor are advantageously positioned substantially perpendicular to the magnetic field 28. As a result, the magnetic field 28 threads the opening and thereby penetrates through the plurality of loops 12. The perpendicular component of the magnetic field creates an open circuit voltage and thereby induces a current on the surface of the conductor forming the plurality of loops 12. The current induced on the plurality of loops 12 is then received by the transceiver 18.

The antenna 10 may likewise transmit a desired signal in a similar but reverse manner. Under transmitting conditions, the transceiver 18 energizes the conductor forming the plurality of loops 12 with a current signal. The current flowing through the loops thereby induces magnetic field 28 through the face of and perpendicular to the plurality of loops 12. The magnetic field 28 thereby induces an electric field and therefore a current on the surface of the conductive structure.. The electric field formed on the surface of the conductive structure allows for transmission of the signal to a remote receiver.

Figure 3:
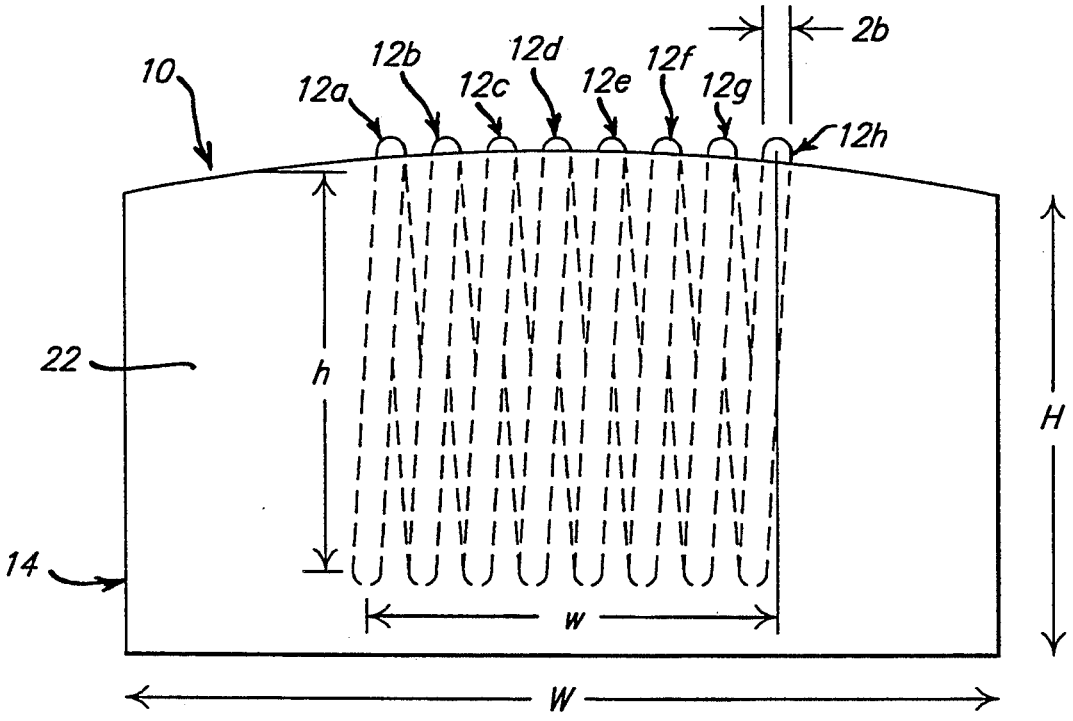
FIG. 3 is a schematic diagram which illustrates the dimensional parameters of a multi-turn loop antenna in a cavity in accordance with the present invention.

FIG. 3 illustrates an example of the dimensional parameters of a multi-turn loop antenna 10. The antenna 10 shown therein includes eight-turn loops 12*a* through 12*h* having a multi-turn loop width w and height h. The eight loops 12*a* through 12*h* are made of a conductive material such as copper and are mounted within the cavity 22 of the cavity assembly 14'. The cavity assembly 14 has a cavity width W and a cavity height H. The plurality of loops 12*a* through 12*h* should preferably be positioned close to the center of the aperture of the cavity 22. Furthermore, to reduce proximity effects, the plurality of loops 12*a* through 12*h* require a spacing of at least the width 2*b* of a single loop.

Figure 4A:
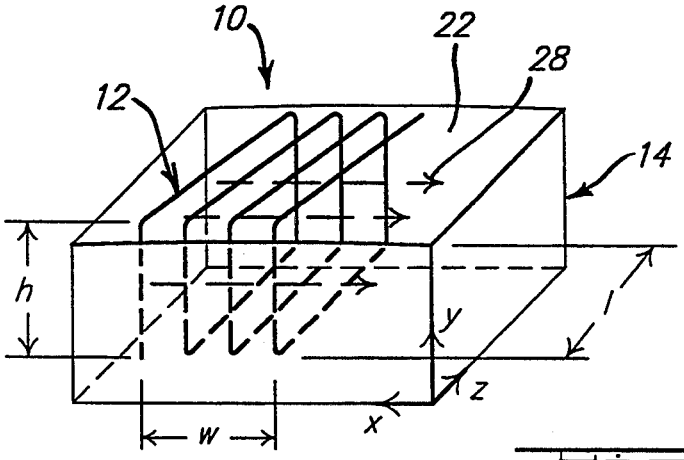
FIG. 4*a* is a schematic diagram which illustrates a perspective view of the multi-turn loop antenna shown in FIG. 3.

FIG. 4*a* illustrates a perspective view of a multi-turn loop antenna within a cavity structure 14. The plurality of loops 12 as shown therein form the shape of a rectangle having a cross-sectional opening in the X=0 plane. The plurality of loops 12 are mounted within the cavity assembly 14 which in turn is preferably embedded within a structure having a conductive surface. The conductive surface may be magnetically coupled by the plurality of loops 12 to thereby provide magnetic field 28 along the x-axis when transmitting or receiving signal. The plurality of loops 12 are advantageously positioned such that the magnetic field 28 penetrates through the opening in the plurality of loops 12 and perpendicular thereto.

Figure 4B:
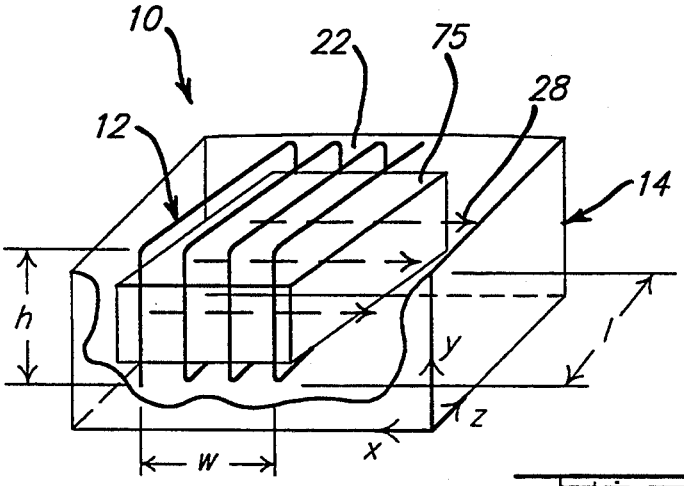
FIG. 4*b* is a schematic diagram which illustrates a multi-turn loop antenna having a magnetic core in accordance with an alternate embodiment of the present invention.

In an alternate embodiment, the radiation resistance of the multi-turn loop antenna 10 can be increased by winding the plurality of loops 12 on a magnetic core 75 as illustrated in FIG. 4*b*.

Figure 5:
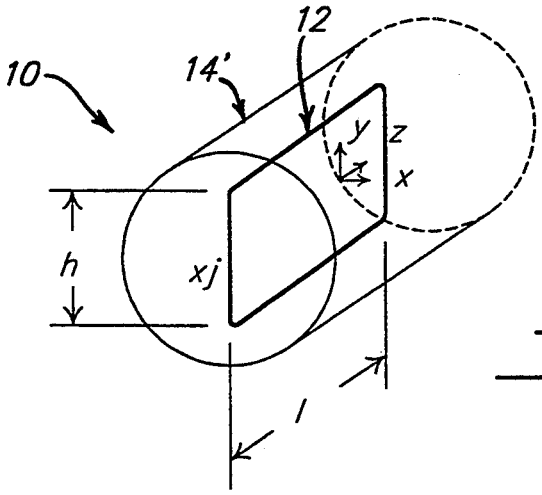
FIG. 5 is a schematic diagram which illustrates a loop antenna positioned within a cylindrical cavity.

The conductor forming the plurality of loops 12 as described herein forms a rectangular shaped opening. However, for purposes of this invention the plurality of loops 12 may take on other shapes and sizes without departing from the spirit of the invention. Since small antennas are more or less shape independent, various cavity structures may also be employed such as the cylindrical shape cavity structure shown in FIG. 5. Furthermore, the conductor shown in FIG. 5 forms a single closed loop. As such, the transceiver 18 may be magnetically coupled therewith. In addition, a single loop may be employed, however, a higher number of loops will advantageously provide a higher antenna efficiency.

Figure 6:
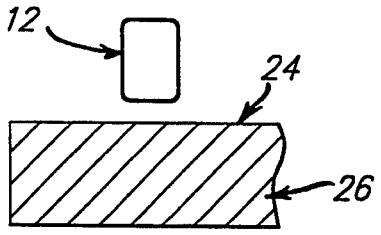
FIG. 6 is a cross-sectional view of a multi-turn loop antenna positioned on the surface of a conductive structure.

FIG. 6 illustrates a loop antenna 10 having the plurality of loops 12 positioned on top of the surface of a conductive structure 26 having a conductive surface 24. Most of the cavity assembly is removed to enhance operational efficiency. The conductive structure 26 may include the airframe of an aircraft or other structure having a conductive surface 24. The antenna 10 generally provides an enhanced operational efficiency when mounted above the surface instead of embedded within the surface. However, an embedded antenna may be necessary to meet low profile requirements. A low profile may avoid problems such as increased drag which may result in undesirable maneuverability problems for an aircraft.

In the alternative, the plurality of loops 12 of the antenna 10 may be partially embedded within the surface of the conductive structure 26. A partially embedded antenna equipped with the partial cavity assembly 14 and a bubble-type radome covering the portion protruding above the surface may serve as a compromise.

Figure 7:
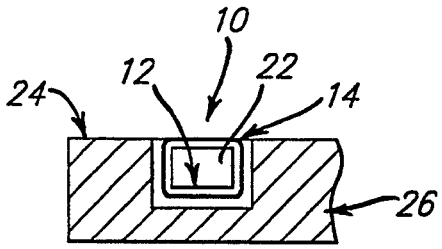
FIG. 7 is a cross-sectional view of a multi-turn loop antenna embedded within a conductive structure in accordance with the present invention.

FIG. 7 illustrates a loop antenna 10 embedded within and conformally flush mounted with the surface of a conductive structure 26. A sufficiently large cavity generally has no significant impact on the performance and operation of the antenna 10 since the current induced on the conductive structure 26 is not significantly affected. However, this invention uses a relatively small cavity in which the cavity design may determine antenna efficiency. Unlike the large cavity, the small cavity does affect the current induced on the conductive structure 26.

The cavity assembly 14 is preferably designed such that the first anti-resonance frequency of the multi-turn loop antenna 10 occurs an octave or more higher than the lowest operating frequency. In essence, the multi-turn loop antenna 10 is essentially tuned in the vicinity of its first anti-resonance frequency. When suitably located, the strong magnetic coupling to the conductive structure 26 will provide increased radiation efficiency.

For purposes of this invention the cavity dimensions are preferably a very small fraction of the operating signal wavelength. As such, the cavity structure 14 embedded within a conductive structure 26 with the plurality of loops 12 removed may be approximated as a cavity or waveguide below cut-off where magnetic fields can penetrate but energy cannot propagate into the cavity. The coupling formed between the recessed antenna 10 and the external magnetic field 28 is purely an inductive or a capacitive coupling. Therefore, to further increase the efficiency of a recessed antenna 10, the purely reactive attenuation should be minimized. Since the coupling of the magnetic field to the cavity is exponential, a relatively shallow and wide loop near the opening of the cavity may provide the greatest efficiency.

Figure 8A:
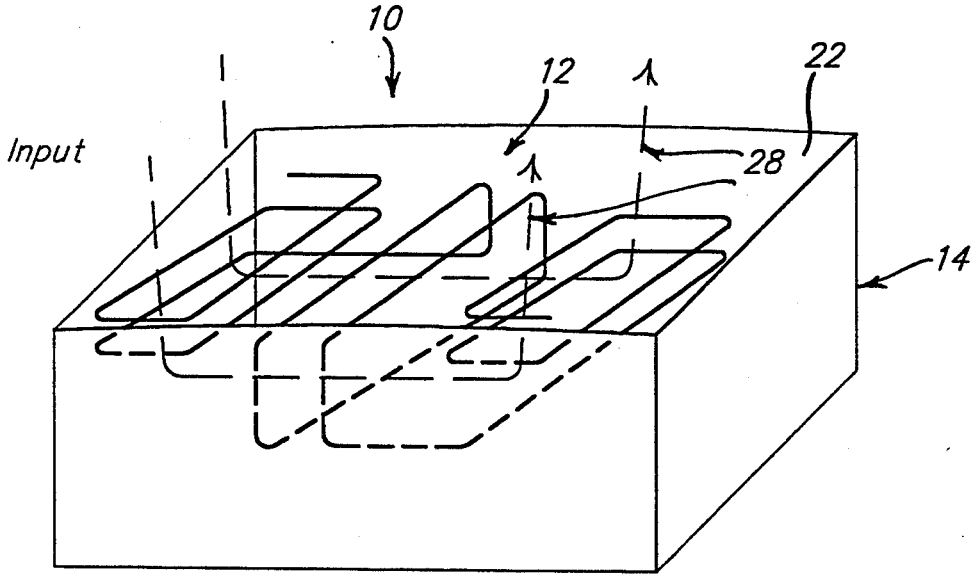
FIG. 8*a* is a schematic diagram which illustrates a multi-turn loop antenna having optimum coupling in accordance with the present invention.
Figure 8B:
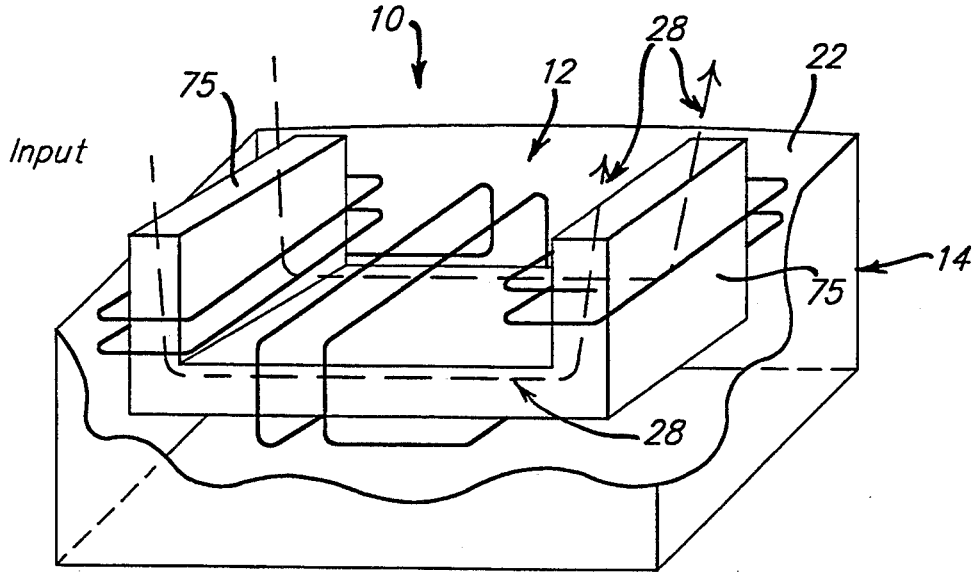
FIG. 8*b* is a schematic diagram which illustrates a multi-turn loop antenna having a magnetic core in accordance with an alternate embodiment of the present invention.

FIG. 8*a* illustrates a multi-turn loop antenna 10 having the plurality of loops 12 positioned for optimal coupling within the cavity assembly 14. The direction of the magnetic field 28 generally varies within the cavity 22. To maximize the magnetic coupling, each of the plurality of loops 12 are individually oriented within the cavity 22 to accommodate for the varying direction of the magnetic field 28 within the cavity 22. As a result, the plurality of loops 12 in the example shown form a toroidal-shape coil near the cavity opening. In the alternate embodiment, the radiation resistance can be increased by winding the plurality of loops 12 on a toroidal-shape magnetic core 75 as illustrated in FIG. 8*b*.

Figure 9:
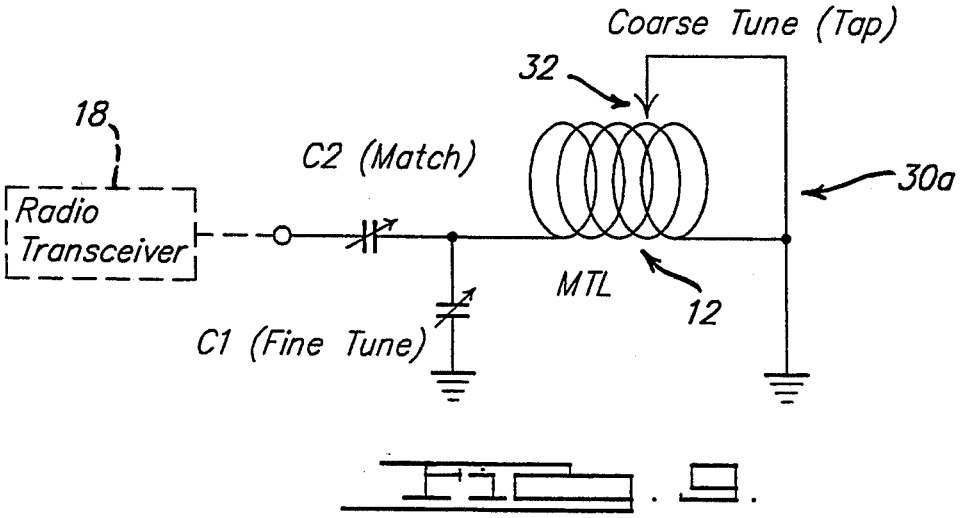
FIG. 9 is a circuit diagram which illustrates a tuning and impedance-matching circuit for a multi-turn loop antenna.
Figure 10:
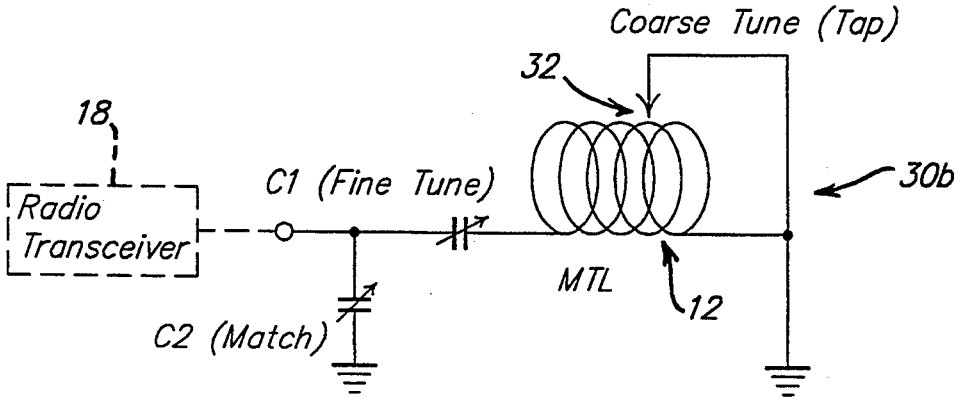
FIG. 10 is a circuit diagram which illustrates an alternate tuning and impedance-matching circuit for tuning a multi-turn loop antenna.
Figure 11:
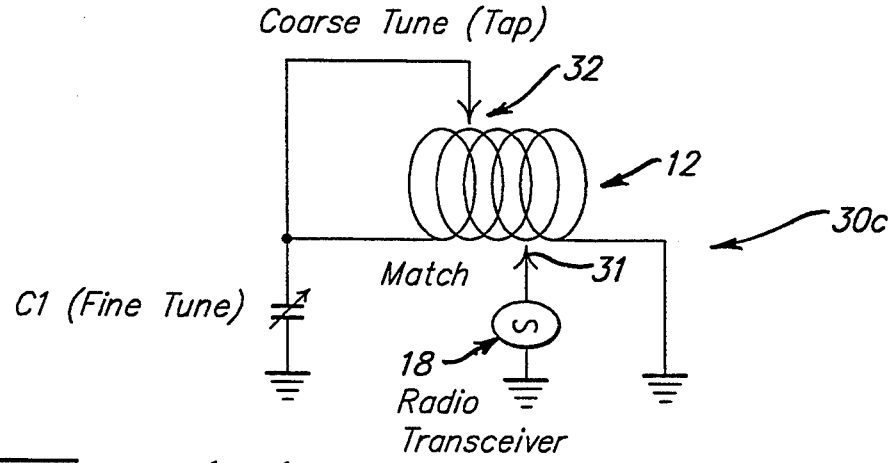
FIG. 11 is a circuit diagram which illustrates an alternate tuning impedance-matching circuit for tuning a multi-turn loop antenna.

FIGS. 9 through 11 illustrate various tuning and impedance matching circuits 30*a* through 30*c* which may be employed for tuning a loop antenna to a desired operating frequency range. The tuning circuits 30*a* through 30*c* provide for both a coarse tuning and a fine tuning adjustment. These circuits are located inside or adjacent the loop cavity. The coarse tuning includes a tap 32 which essentially short-circuits a desired number of loop turns 12 to thereby raise the anti-resonance frequency. The fine tuning adjustment can be achieved by using a variable capacitor C1. The variable or stepped capacitor C1 may include a high voltage vacuum variable capacitor or a combination of fixed and variable capacitors. A capacitor C2 in circuits 30*a* and 30*b* and a match tap 31 in circuit 30*c* provide for impedance matching.

The multi-turn loop antenna 10 should be suitably located on the conductive structure so that strong magnetic coupling is provided. The desired location of a multi-turn loop antenna 10 on the airframe of an aircraft is generally preferred to be a mid-ship location. In essence, the antenna 10 should be positioned at or near a current loop of the adjacent conductive structure. Radiation pattern shape may be impacted by the current distribution on the aircraft; however, the pattern shape can usually be predicted and controlled by proper placement of the antenna 10.

Figure 12A:
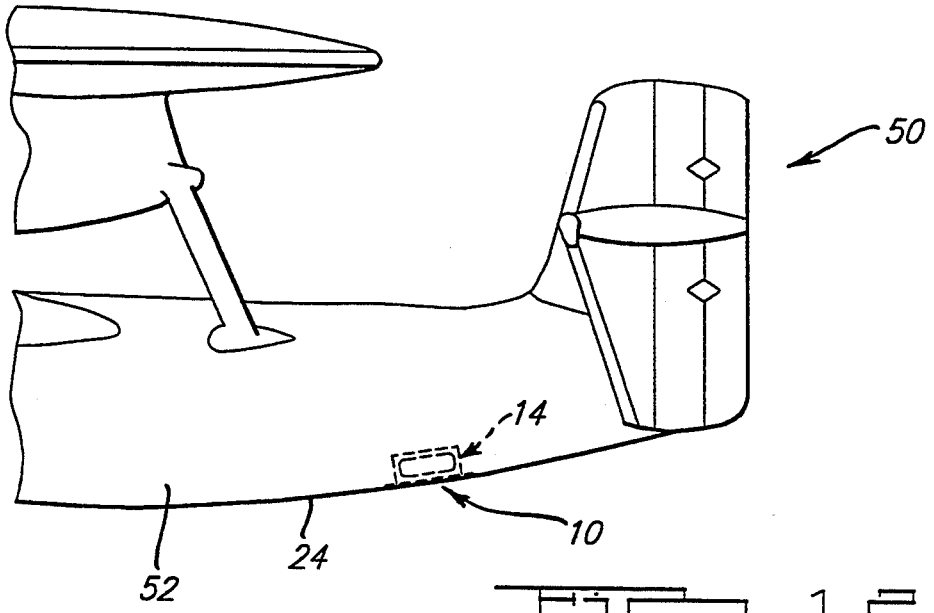
FIG. 12*a* and 12*b* illustrates a multi-turn loop antenna installed on an aircraft.
Figure 12B:
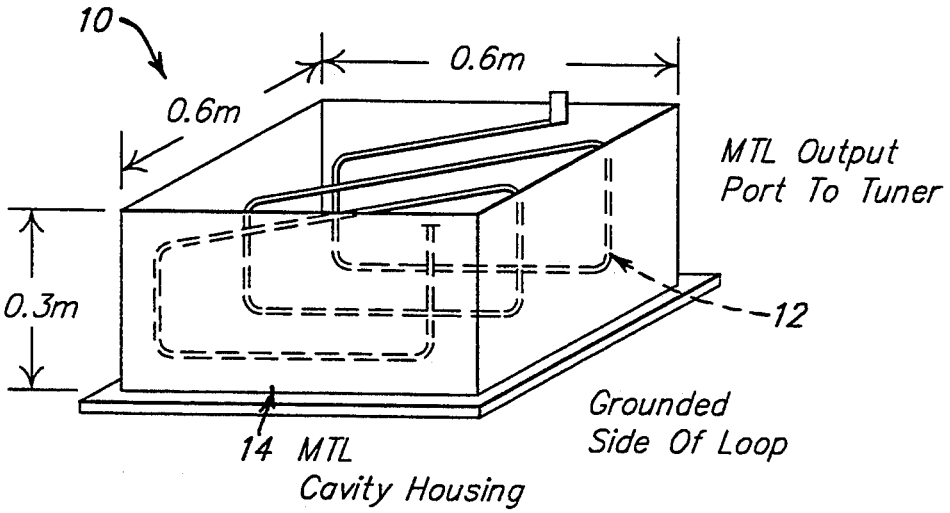

FIG. 12*a* and 12*b* illustrate a multi-turn loop antenna installed in the tail section of an aircraft 50. The aircraft 50 preferably has an airframe 52 with a conductive surface 24. In addition, the antenna 10 is embedded in the cavity assembly 14 within the airframe 52.

Figure 13:
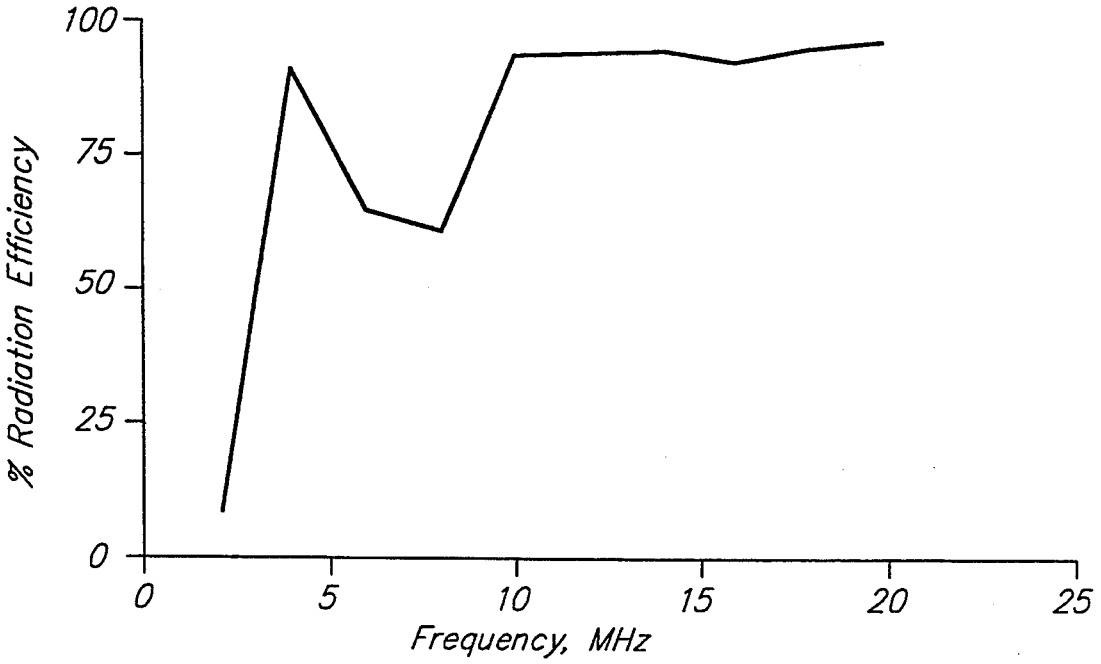
FIG. 13 illustrates high radiation efficiency obtained with the multi-turn loop antenna installed on an aircraft.

FIG. 13 illustrates that very high radiation efficiency may be obtained due to coupling of a multi-turn loop antenna 10 to an aircraft 50.

Figure 14:
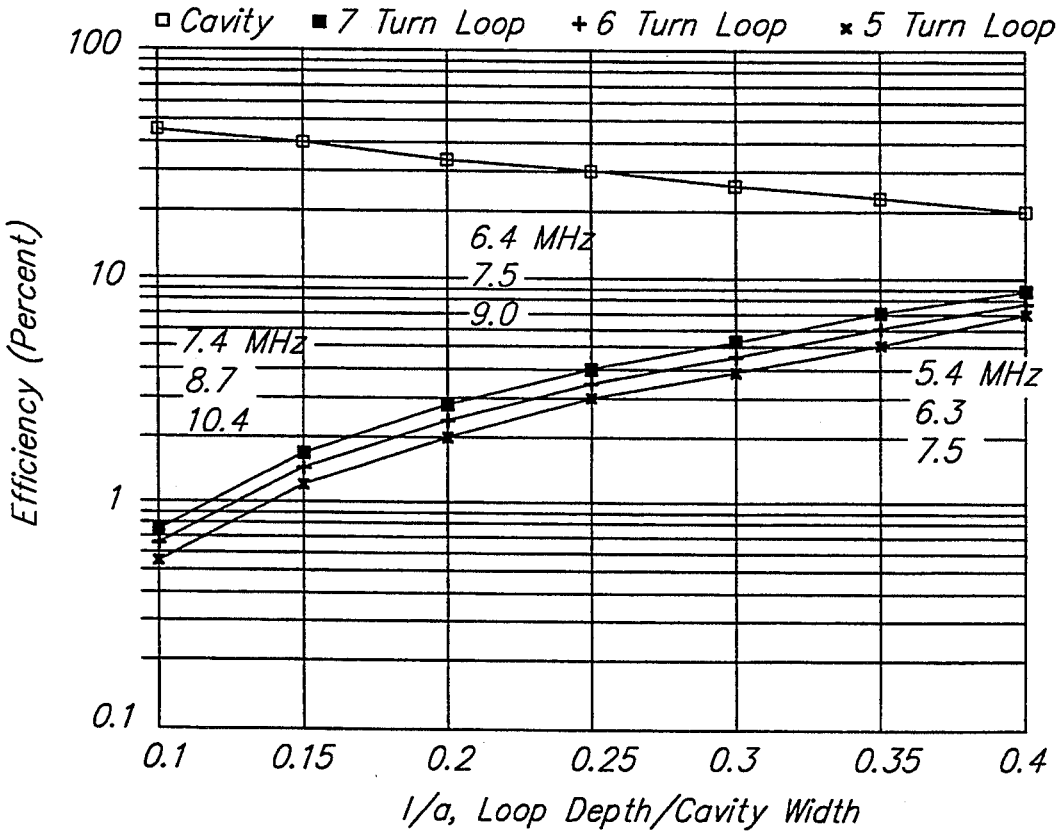
Figure 14 is a graph which illustrates the efficiency of various multi-turn loop antennas.

FIG. 14 is a graph which illustrates the efficiency of several multi-turn loop antennas 10 for various loop depth/cavity width ratios. In this case, the multi-turn loops are not coupled to an aircraft. The first anti-resonance frequencies are further shown for a multi-turn loop antenna 10 on a ground plane. As indicated therein, a larger number of loops generally provides for a higher antenna efficiency. However, there are limits to the number of loops that may practically be used including the size of the cavity. In any event, the design parameters should be carefully chosen to obtain the highest efficiency.

In view of the foregoing, it can be appreciated that the present invention enables the user to achieve a compact high frequency multi-turn loop antenna. Thus, while this invention has been disclosed herein in connection with a particular example thereof, no limitation is intended thereby except as defined by the following claims. This is because a skilled practitioner will recognize that other modifications can be made without departing from the spirit of this invention after studying the specification and drawings.

What is claimed is:

1. A compact high frequency loop antenna comprising:

a conductive surface having a concave cavity formed therein for receiving a magnetic field having a given distribution within the cavity;

current loop means located at least partially in said cavity and including a plurality of conductive loop elements forming a plurality of openings therein, each loop element being located in said cavity as a function of the distribution of the magnetic field distribution in said cavity, wherein at least two loop elements form different angles relative to each other to enhance the magnetic coupling between said current loop means and said conductive surface; and a first terminal coupled to said conductive loop element and providing electrical connection to a transceiver for transmitting and receiving desired signals.

2. The antenna as defined in claim 1 wherein said loop elements are oriented so that the planes of said loop elements are substantially perpendicular to the direction of said magnetic field.

3. The antenna as defined in claim 1 wherein said loop elements are flush mounted completely within said cavity.

4. The antenna as defined in claim 3 wherein said cavity is a conductive cavity which has a non-conductive side that allows a magnetic field to penetrate therethrough.

5. The antenna as defined in claim 1 wherein each loop element is separated from an adjacent loop element by at least a width of a single loop.

6. The antenna as defined in claim 5 further comprising:

tuning means for tuning said antenna.

7. The antenna as defined in claim 6 wherein said tuning means comprises:

coarse tuning means including a first tap for short-circuiting one or more loops; and fine tuning means including a first variable capacitor.

8. The antenna as defined in claim 7 further comprising impedance matching means for adjusting the impedance.

9. The antenna as defined in claim 8 wherein said impedance matching means includes a second variable capacitor and a second tap.

10. The antenna as defined in claim 1 further comprising a magnetic core located within said openings in said plurality of loop elements.

11. A high frequency multi-turn loop antenna for use on a conductive surface such as the airframe of an aircraft for receiving a desired magnetic field having a given distribution, said antenna comprising:

current loop means including a conductor forming a plurality of loops which are located in a cavity provide in said conductive surface, said loops having openings therein and positioned as a function of the distribution of the magnetic field in said cavity and at a preselected angle with respect to each other so that loops provide optimum magnetic coupling with said conductive surface, and wherein at least two of said loops form different angles relative to each other.

12. The antenna as defined in claim 11 wherein said cavity is a conductive cavity having an open non-conductive side exposing said loops to said magnetic coupling.

13. The antenna as defined in claim 11 wherein said loops are located substantially within said cavity and arranged in an approximate toroidal shape.

14. The antenna as defined in claim 11 further comprising:

tuning means for tuning said antenna; and impedance matching means for adjusting the impedance.

15. The antenna as defined in claim 14 wherein said tuning means comprises:

coarse tuning mans including a tap for short circuiting one or more loops; and fine tuning means including a variable capacitor.

16. The antenna as defined in claim 14 wherein said impedance matching means includes a variable capacitor and a tap.

17. The antenna as defined in claim 11 wherein each of the plurality of loops are separated by at least a width of the conductor.

18. The antenna as defined in claim 11 further comprising a magnetic core located in said opening provided by said loops.

19. A low profile high frequency multi-turn loop antenna system for use on a conductive surface, said antenna-system comprising:

a conductive concave cavity formed in the conductive surface for receiving a magnetic field having a given distribution;

a loop antenna having a conductor forming a plurality of loops having openings therein, said loops being located substantially within said conductive cavity and oriented as a function of the distribution of the magnetic field in said cavity, wherein at least two of the loops form different angles relative to each other so as to form a magnetic coupling between said loops and said conductive surface; and transceiver means electrically coupled to said loop antenna for transmitting and receiving desired signals.

20. The antenna system as defined in claim 19 further comprising:

tuning means for tuning said antenna; and impedance matching means for adjusting impedance.

21. The antenna system as defined in claim 19 further comprising a magnetic core located within said openings in said loops.

22. A method for forming a loop antenna system for transmitting and receiving high frequency signals, said method comprising:

forming a plurality of loops from a conductive loop element;

forming a conductive cavity in a conductive surface so that said cavity has a non-conductive side for allowing magnetic fields to penetrate therethrough;

mounting the loops in the cavity in said conductive surface so as to form a magnetic coupling between said loops and said conductive surface;

arranging said loops according to the distribution of a magnetic field inside the cavity and so that at least two of the loops form different angles relative to each other so as to provide optimum magnetic coupling between said loops and conductive surface via the non-conductive side of the cavity; and coupling a transceiver to said conductive loop element to enable transmission and reception of selected signals.

* * * * *